US006532818B2

(12) United States Patent
Blankenship

(10) Patent No.: US 6,532,818 B2
(45) Date of Patent: Mar. 18, 2003

(54) METHOD AND APPARATUS FOR MEASURING A VIBRATIONAL CHARACTERISTIC OF A GOLF CLUB SHAFT

(75) Inventor: Jeffrey A. Blankenship, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 09/835,655

(22) Filed: Apr. 16, 2001

(65) Prior Publication Data

US 2002/0148292 A1 Oct. 17, 2002

(51) Int. Cl.[7] ..... G01N 19/06; G01N 3/00

(52) U.S. Cl. ..... 73/579; 73/651; 73/812; 73/849; 73/856; 702/43; 702/56

(58) Field of Search ..... 73/579, 649, 650, 73/651, 812, 814, 847, 849, 856; 702/43, 56

(56) References Cited

U.S. PATENT DOCUMENTS 3,395,571 A * 8/1968 Murdoch ..... 473/289
4,070,022 A * 1/1978 Braly ..... 473/289
4,928,965 A * 5/1990 Yamaguchi et al. . 273/DIG. 22
5,040,279 A 8/1991 Braly ..... 29/407
5,379,641 A * 1/1995 Paasivaara et al. ..... 473/289
5,616,832 A 4/1997 Nauck ..... 73/65.03
5,703,294 A 12/1997 McConnell et al. ..... 73/579
5,731,524 A * 3/1998 Matsumoto et al. ..... 73/650
5,952,580 A * 9/1999 Haas ..... 73/783
6,155,707 A 12/2000 Brehier et al. ..... 366/110
6,405,595 B1 * 6/2002 Harrison ..... 73/573

* cited by examiner

*Primary Examiner*—Daniel S. Larkin
*Assistant Examiner*—Rose M. Miller
(74) *Attorney, Agent, or Firm*—Darrell F. Marquette; Rennie Wm. Dover

(57) ABSTRACT

An apparatus and a method for determining a vibrational characteristic of a golf club shaft. The apparatus includes a table having a clamping structure for clamping the golf club shaft thereto. A multi-dimensional accelerometer is coupled to a tip end of the golf club shaft. The multi-dimensional accelerometer is also coupled to a computer. When the golf club shaft is vibrated, the multi-dimensional accelerometer converts the vibrational signal into an electrical signal which is transmitted to the computer. The computer conditions the electrical signal and outputs a signal indicative of the frequency of vibration of the golf club shaft. The stiffness of the golf club shaft is determined from the vibrational frequency of the golf club shaft.

21 Claims, 5 Drawing Sheets

METHOD AND APPARATUS FOR MEASURING A VIBRATIONAL CHARACTERISTIC OF A GOLF CLUB SHAFT

BACKGROUND OF THE INVENTION

This invention relates, in general, to a method and apparatus for measuring physical properties of golf club shafts and, more particularly, to a method and apparatus for measuring a vibrational characteristic or property of a golf club shaft.

In the field of designing, modifying, and fitting golf clubs, it is advantageous to know the physical properties of the golf club shaft as well as the physical properties of the golf club head. It is common in the industry to rate clubs based on the flexural stiffness designated typically by the terms: Extra Stiff (XS); Stiff (S); Firm (F); Regular (R); Average (A); and Ladies (L). The flexural stiffness is important because it determines the maximum bending as well as the first bending mode frequency of the shaft and, therefore by selecting the appropriate shaft stiffness, the club can be optimized for the swing speed of the particular golfer. The torsional stiffness of the golf club is also important because it determines the maximum windup of the club head relative to the shaft and the torsional frequency at which the club head oscillates about the axis of the golf club shaft during the swing. For optimum performance, in addition to matching the flexural stiffness of the shaft to the player's swing speed, the torsional stiffness of the shaft should also be matched to the club head swing weight and the player's swing speed. Another important physical property of the golf club shaft is its frequency of oscillation because it provides a reproducible and reliable index of shaft flexibility. Further, the frequency of oscillation allows frequency matching of golf clubs to form a set of golf clubs which have a substantially uniform "feel" to the golfer.

A common prior art method for measuring the frequency of oscillation of the golf club shaft includes fixing one end of the shaft in a clamp and causing the club to vibrate or oscillate along a single axis. The vibrations are measured using several sets of light emitting diodes in combination with a counter. Limitations of this technique include the inability to measure oscillations along more than a single axis and the inability of the frequency measurement tools to properly operate when the golf club shaft oscillates in more than one axis.

SUMMARY OF THE INVENTION

The present invention provides a method and an apparatus for determining the frequency of oscillation or the vibrational frequency of a shaft by measuring the oscillatory behavior of the shaft. In a preferred embodiment of an apparatus for measuring the vibration of a golf club shaft incorporating features of the present invention, a clamping mechanism is provided for securing one end of a shaft to a support structure of the apparatus. An accelerometer is coupled to the other end of the shaft. The tip end of the golf club shaft is vibrated and the accelerometer provides a signal indicative of the amplitude and frequency of oscillation of the tip end of the golf club club shaft, which is fed into a computer. The computer is programmed with the stiffness equation for a golf club shaft and is therefore able to compute the stiffness of the shaft based on the frequency of oscillation.

DESCRIPTION OF THE PREFERRED EMBODIMENT

Figure 1:
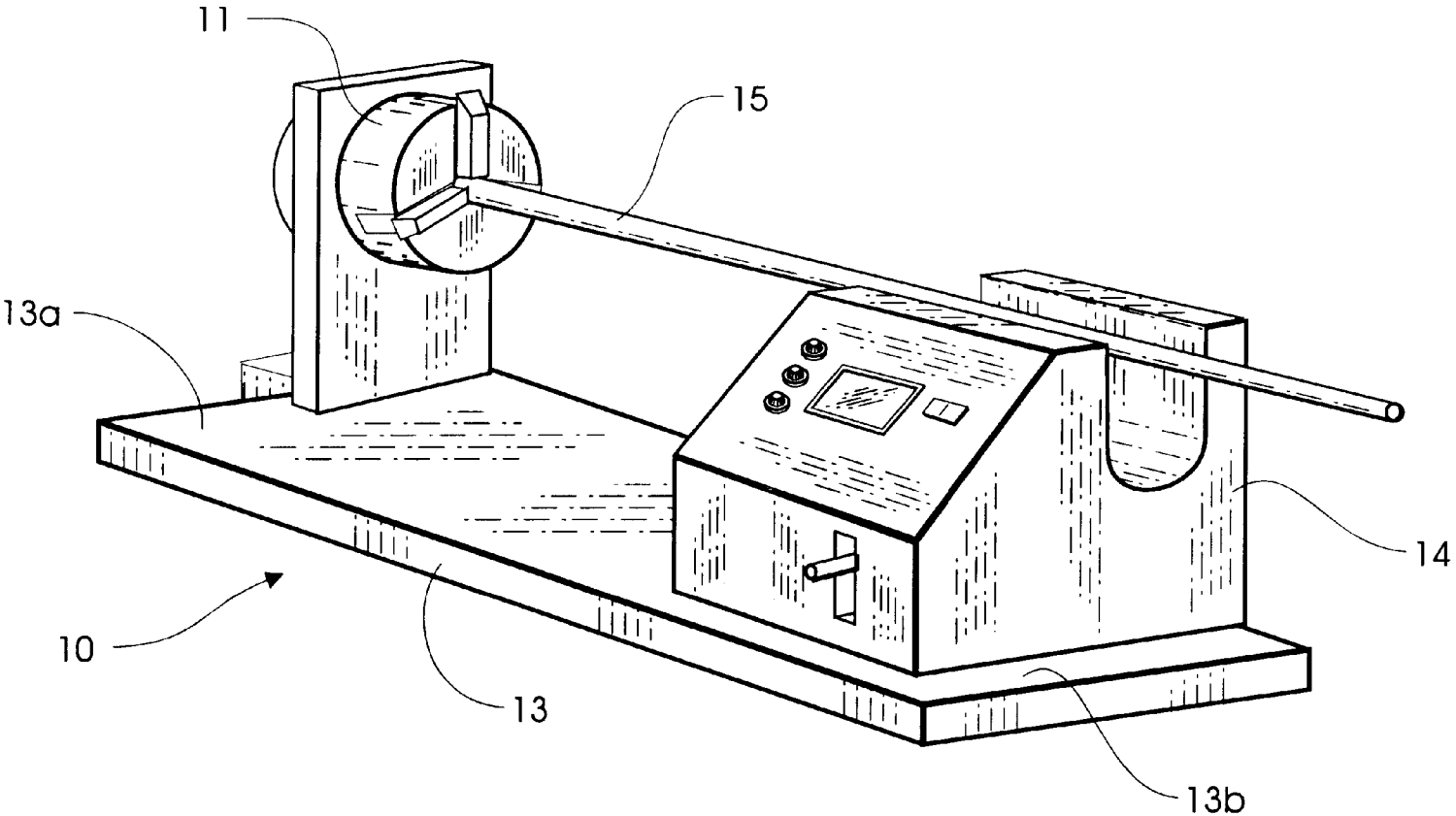
Prior Art Fig. 1
FIG. 1 is an elevated side view of an apparatus for measuring frequency properties of a golf club shaft in accordance with the prior art.

FIG. 1 is an elevated side view of an apparatus 10 for measuring frequency properties of a golf club shaft in accordance with the prior art. Apparatus 10 includes a clamp 11 coupled to a first portion 13*a* of a frame 13 and an electronic counter 14 coupled to a second portion 13*b* of the frame 13. A golf club shaft 15 is inserted into clamp 11. In operation, golf club shaft 15 is made to vibrate, wherein the frequency of vibration is measured by electronic counter 14. A deficiency in this technique is that when the vibrations are not in a single plane, electronic counter 14 is not able to accurately measure the frequency of oscillation of golf club shaft 15.

Figure 2:
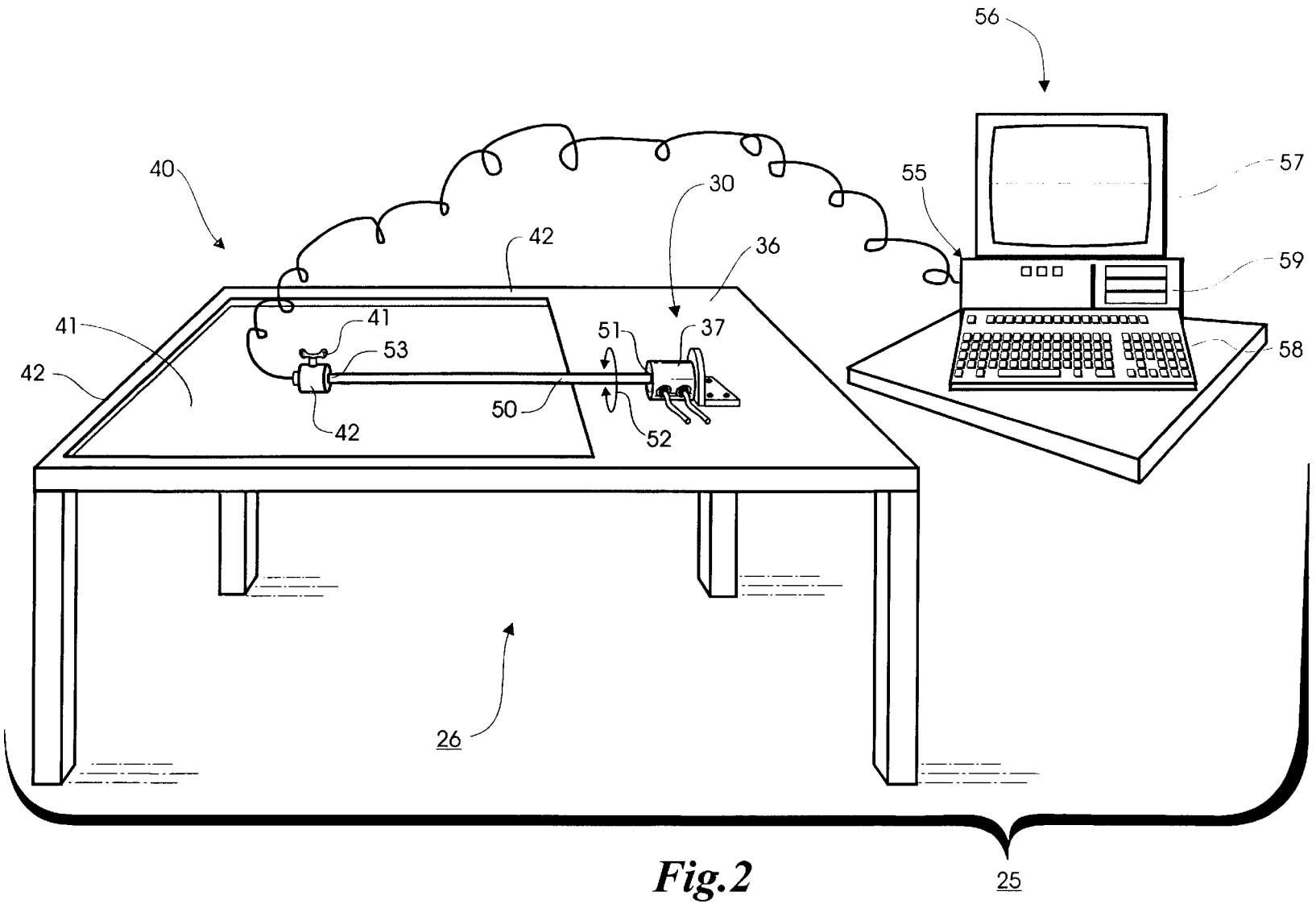
FIG. 2 is a side view of an apparatus for measuring the vibrational behavior of a golf club shaft in accordance with the preferred embodiment of the present invention.

FIG. 2 is a partial schematic elevational view of an apparatus 25 incorporating features of the present invention. Apparatus 25 comprises a recessed table 26 having a clamping portion 30 and a frequency measurement portion 40. In accordance with a first embodiment, clamping portion 30 comprises a rotatable cylindrical clamp 37 having an adjustable inner diameter. Initially, the inner diameter of adjustable clamp 37 is adjusted to be greater than the diameter of a golf club shaft 50. A butt end 51 of golf club shaft 50 is inserted into cylindrical clamp 37. After insertion of butt end 51, clamp 37 is actuated so that its inner diameter is reduced until it firmly grips butt end 51 of golf club shaft 50.

A useful feature of the embodiment of the clamping portion shown in FIG. 2 is that clamp 37 is rotatable about its longitudinal axis while still remaining clamped as indicted by arrows 52. As those skilled in the art are aware, golf club shafts are not symmetric along their longitudinal axes. Hence, they tend to bend more in one direction. By being rotatable, cylindrical clamp 37 enables an operator to rotate a golf club shaft coupled therein about its longitudinal axis and thereby take frequency measurements of golf club shaft 50 in any direction perpendicular to the length of golf club shaft 50.

Figure 2A:
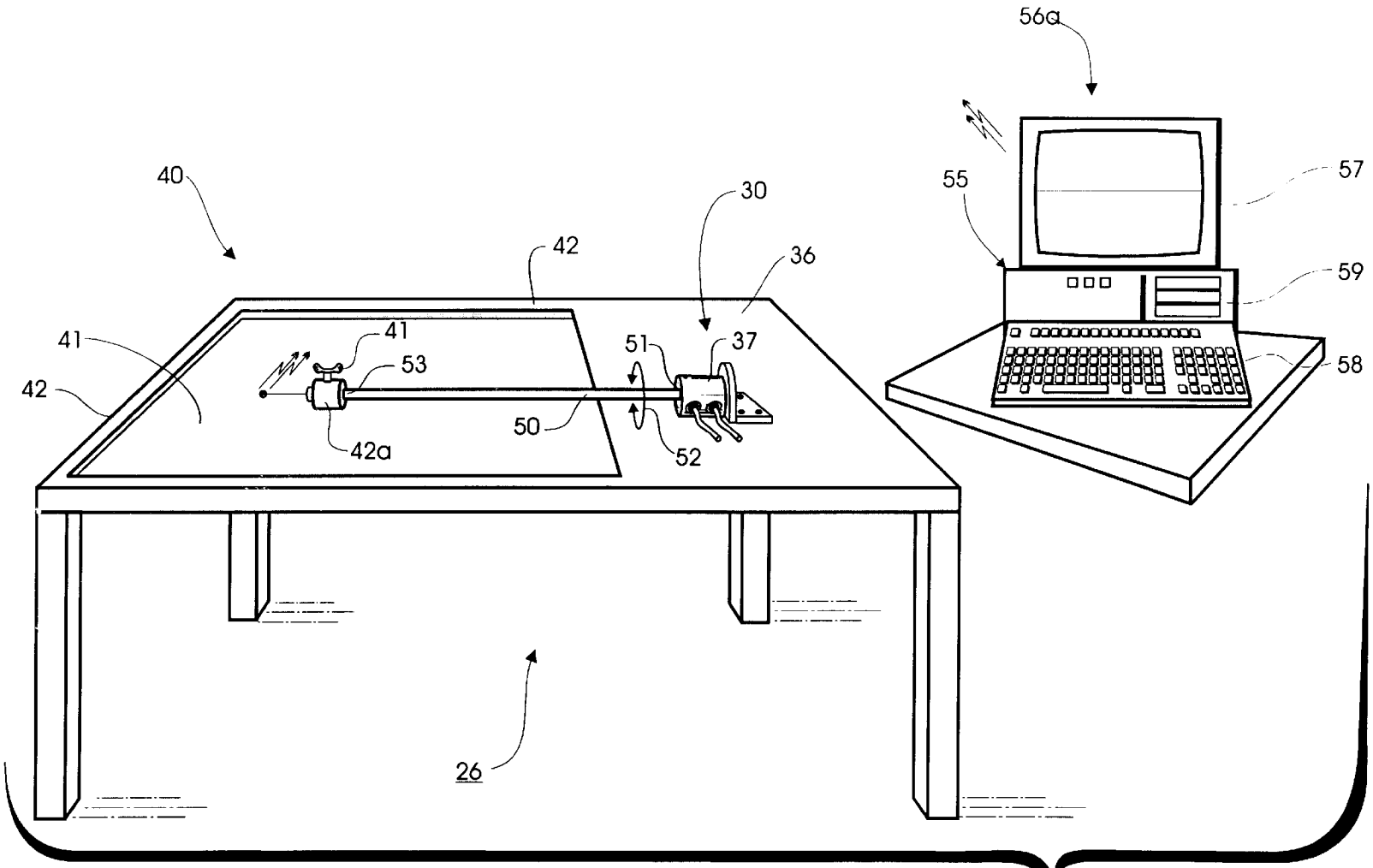
FIG. 2A is a side view of an apparatus for measuring the vibrational behavior of a golf club shaft in accordance with an alternative embodiment of the present invention.

Frequency measurement portion 40 includes a multi-dimensional accelerometer 41 coupled to a digital computer 56, which computer includes a monitor or display 57, a keyboard, 58, and a console 59. A suitable accelerometer is a biaxial accelerometer chip such as a VTI Hamlin SCA600 which is mounted to a chip support 42 such that the axis of sensitivity is oriented in the tangential plane relative to the longitudinal axis of golf club shaft 50. The analog output of accelerometer 41 is fed into an analog-to-digital converter, such as a model PCB482A17 signal conditioner 55, prior to conversion into digital data which can be read by a conventional computer 56 for processing. The analog-to-digital converter may be included in console 59. After reading the digital data, computer 56 displays the digital data on a computer screen 57. Although accelerometer 41 and computer 56 are shown as being coupled by cables, i.e., a solid medium, it should be understood this is not a limitation of the present invention. For example, as shown in FIG. 2A, communication between accelerometer 41A and computer 56A may be via wireless means.

Figure 3A:
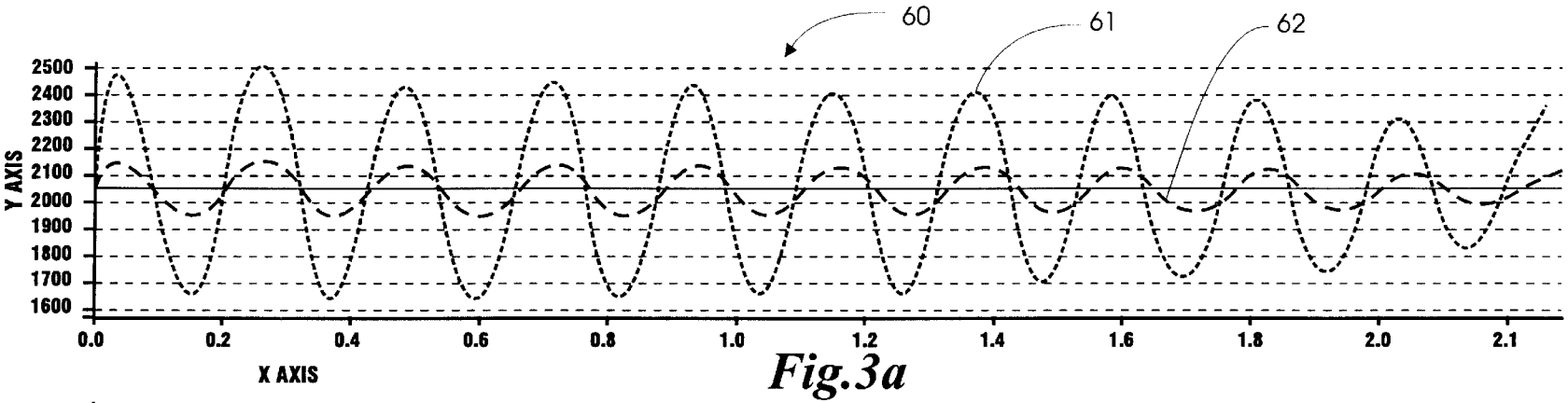
FIGS. 3*a* and 3*b* are screen prints from a computer display illustrating the output signals from a multi-dimensional accelerometer in accordance the preferred embodiment of the present invention.
Figure 3B:
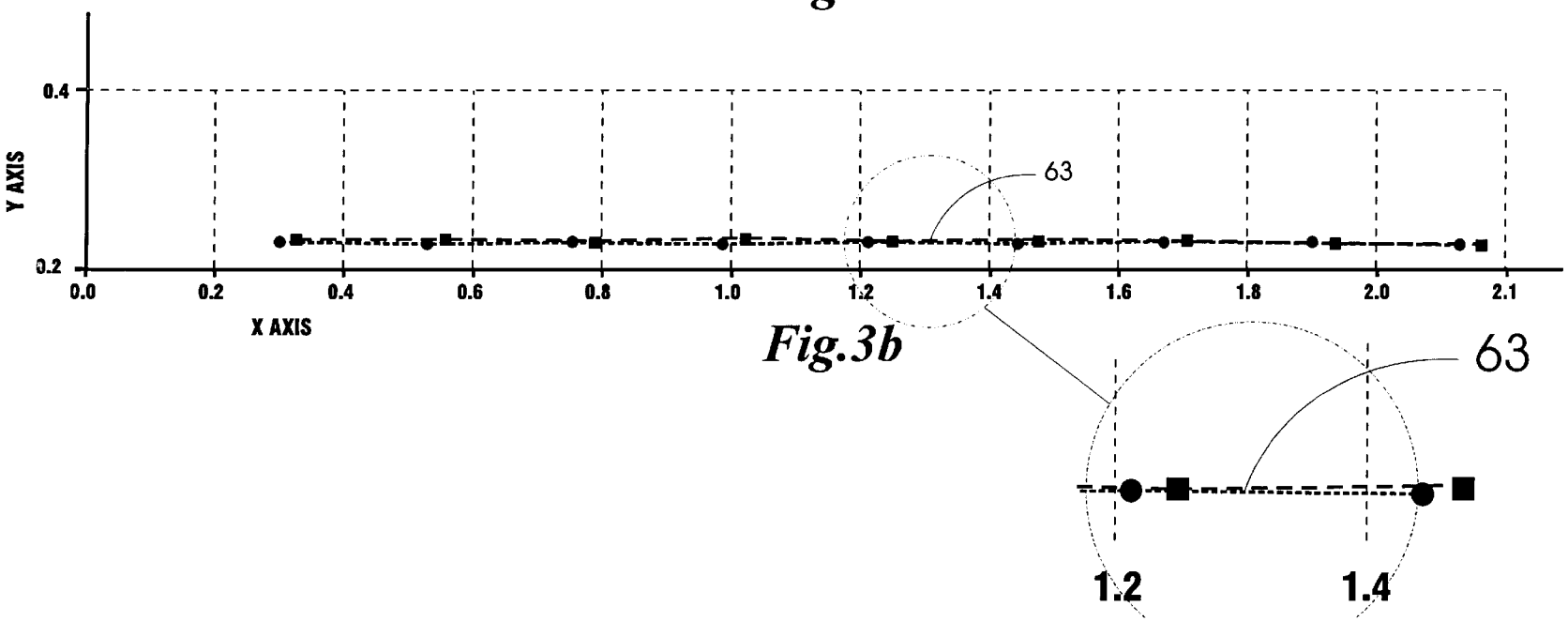

In operation, the butt end 51 of golf club shaft 50 is clamped by clamping portion 30 and multi-dimensional accelerometer 41 is coupled to the tip end 53. The tip end 53 of golf club shaft 50 is displaced from a resting position and released, i.e., golf club shaft 50 is caused to vibrate. It should be understood that the end of golf club shaft that is clamped is not a limitation of the present invention, i.e, the tip end 53 of golf club shaft 50 can be clamped by clamping portion 30. Accelerometer 41 senses the vibrations of golf club shaft 50 and converts them into a signal which is conditioned for output on a suitable medium. In accordance with one example, the conditioned signal is displayed on computer screen 57 as illustrated in FIG. 3. What is shown in FIG. 3*a* is a screen-print 60 from computer screen 57 showing the horizontal 61 and vertical 62 components of the output signal from accelerometer 41. The horizontal frequency of oscillation is 4.62 cycles per second (Hertz) and the vertical frequency of oscillation is 4.63 cycles per second (Hertz). In addition, a screen-print or correlation plot 63 shown in FIG. 3*b* indicates how well the data fits or correlates to the frequency of oscillation. More particularly, plot 63 provides an indication of how much noise is included in the horizontal 61 and vertical 62 components. Noise can be introduced by a loose coupling of accelerometer 41 to golf club shaft 50, a loose coupling of golf club shaft 50 in clamping portion 30, wires hitting the fixture, etc.

Figure 4:
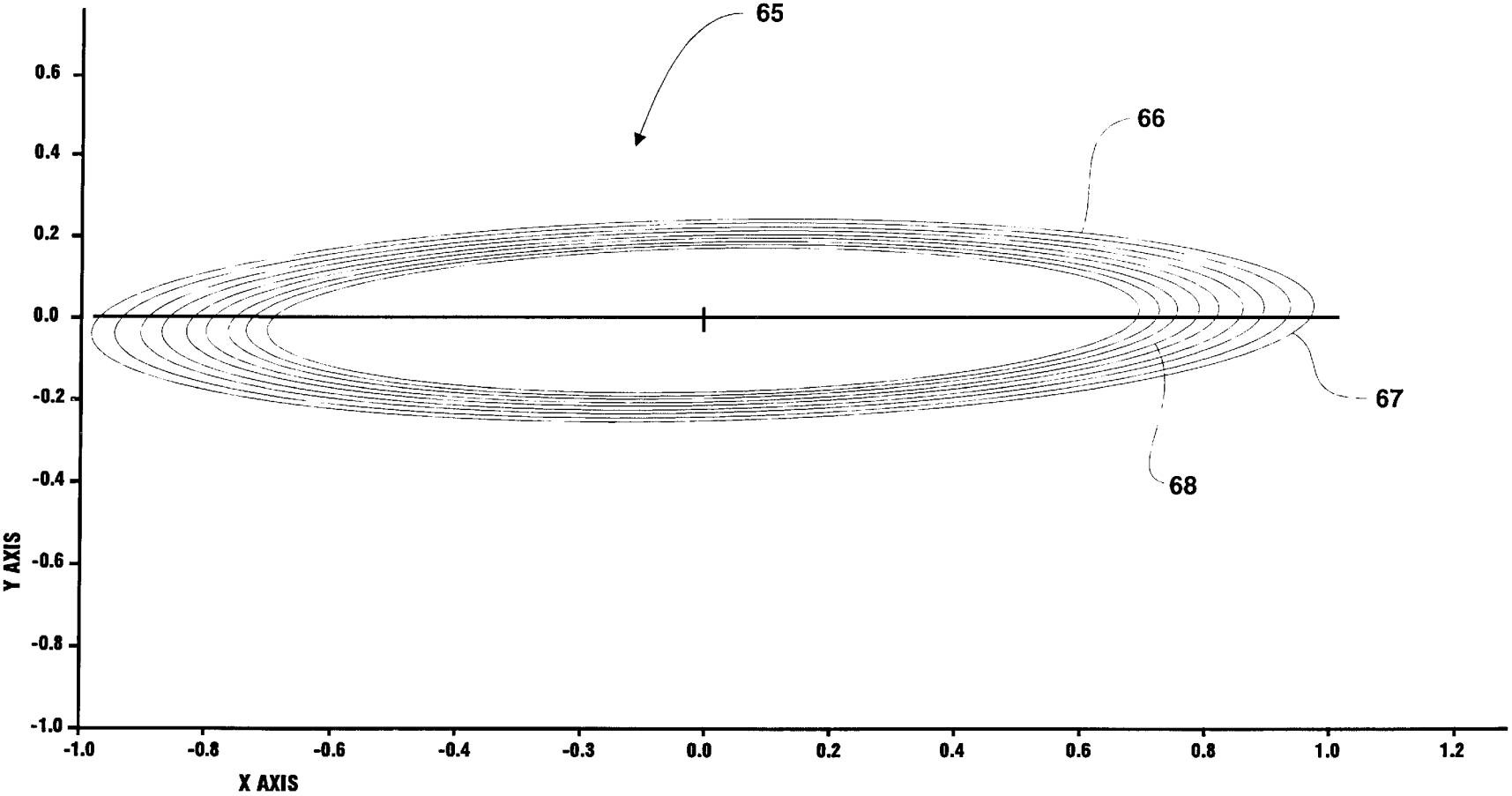
FIG. 4 is a screen print from the computer display illustrating an "X-Y" plot of the vibrational characteristic of a golf club shaft in accordance with the preferred embodiment of the present invention.

FIG. 4 illustrates a screen print 65 showing an "X-Y" plot 66 of the vibrational characteristic of golf club shaft 50. Plot 66 further includes a component that shows the procession of the shaft motion through time. For example, point 67 may represent the motion at time zero, t0, point 68 may represent the motion at time to plus two seconds, etc.

The stiffness of the golf club shaft can be determined from the natural frequency measured using the accelerometer and the following equation:

$$\text{Stiffness}=[(2\Pi fn)^2ML^3]/3 \text{ pound inches}^2$$

where:

fn is the frequency of oscillation (Hertz);

M is the sum of the mass of the head and 23% of the mass of the shaft (grams); and L is the length of the unclamped portion of the shaft (inches).

Because a multi-dimensional accelerometer is used to sense the vibrational properties of golf club shaft 50, the stiffness of golf club shaft 50 can be determined for any orientation of the golf club shaft. In other words, the stiffness of the golf club shaft can be calculated along any radial direction of the golf club shaft with a single measurement.

By now it should be appreciated that an apparatus for measuring a vibrational characteristic or property of a golf club shaft and a method for performing the measurement have been provided. In accordance with an embodiment of the present invention, the apparatus includes an accelerometer coupled to a computer. An advantage of this invention is that it provides a means for measuring the frequency of a golf club shaft in at least two directions, thereby eliminating precession or orbital acceleration errors in the frequency measurement. Further, the measured data may be electronically entered into a computer, rather than being entered by an operator which introduces another source of error. Another advantage of the present invention is that the clamping mechanism allows taking frequency measurements along any direction perpendicular to the longitudinal axis of the golf club shaft. Further, the stiffness of the golf club shaft can be determined from the frequency of oscillation of the golf club shaft.

It will be understood that the apparatus of the present invention may be incorporated into a universal fixture that includes a golf club shaft vibrational measurement system such as disclosed in the co-pending patent application titled "APPARATUS FOR MEASURING TORSIONAL STIFFNESS OF A GOLF SHAFT," filed Aug. 13, 1999 as Ser. No. 09/374,193, now U.S. Pat. No. 6,405,595 and in co-pending patent application titled "METHOD AND APPARATUS FOR MEASURING FLEXURAL CHARACTERISTIC OF A GOLF CLUB SHAFT" filed concurrently with the present application as Ser. No. 09/823,780. An advantage of making a universal fixture is that the vibrational, flexural, and torsional characteristics of a golf club shaft can be determined without removing the golf club shaft from the universal fixture.

What is claimed is:

1. A method for measuring a vibrational characteristic of a golf club shaft, comprising:

providing the golf club shaft, wherein the golf club shaft has a first end and a second end;

coupling the first end of the golf club shaft to a support structure leaving said second end unconstrained;

coupling a multi-dimensional accelerometer to the second end of the golf club shaft;

causing the golf club shaft to vibrate; and using the multi-dimensional accelerometer to measure the vibrational characteristic of the golf club shaft.

2. The method of claim 1, wherein coupling the multi-dimensional accelerometer to the second end of the golf club shaft includes coupling a two dimensional accelerometer to the second end of the golf club shaft.

3. The method of claim 2, wherein causing the golf club shaft to vibrate includes causing the golf club shaft to vibrate in at least one dimension.

4. The method of claim 2, wherein causing the golf club shaft to vibrate includes causing the golf club shaft to vibrate in two dimensions.

5. The method of claim 1, wherein measuring the vibrational characteristic includes transmitting a signal from the multi-dimensional accelerometer to a computer.

6. The method of claim 5, wherein causing the golf club shaft to vibrate includes moving the golf club shaft from an initial position to a displaced position and releasing the golf club shaft from the displaced position.

7. The method of claim 1, wherein coupling the first end of the golf club shaft to the support structure includes clamping a first end of the golf club shaft to the support structure.

8. The method of claim 1, wherein using the multi-dimensional accelerometer to measure the vibrational characteristic includes transmitting a signal from the multi-dimensional accelerometer to a computer via one of a wireless medium or a solid medium.

9. The method of claim 1, further including orienting the multi-dimensional accelerometer to be in a plane substantially perpendicular to the golf club shaft.

10. The method of claim 1, further including using the vibrational characteristic of the golf club shaft to determine the stiffness of the golf club shaft.

11. An apparatus for measuring a vibrational property of a golf club shaft having a longitudinal axis, comprising:

a multi-dimensional accelerometer for mating with the golf club shaft, wherein the multi-dimensional accelerometer senses the vibrational property of the golf club shaft in two dimensions transverse to the longitudinal axis of the golf club shaft; and a computer coupled to the multi-dimensional accelerometer.

12. The apparatus of claim 11, wherein the multi-dimensional accelerometer is coupled to the computer through an analog-to-digital converter.

13. The apparatus of claim 12, wherein the multi-dimensional accelerometer is mounted to a support structure.

14. The apparatus of claim 11, further including a support structure having first and second portions, the first portion including a clamping mechanism.

15. The apparatus of claim 14, wherein the clamping mechanism includes stops for mitigating bowing of the golf club shaft.

16. The apparatus of claim 14, wherein the clamping mechanism further includes a first stop substantially perpendicular to a second stop, and a movable stop that is hydraulically actuated.

17. The apparatus of claim 11, wherein the multi-dimensional accelerometer is coupled to the computer via a solid medium.

18. The apparatus of claim 11, wherein the multi-dimensional accelerometer is coupled to the computer via a wireless means.

19. An apparatus for measuring a vibrational property of a golf club shaft having a longitudinal axis, comprising:

a support structure having a portion for receiving the golf club shaft; and a multi-dimensional sensor for measuring the frequency of oscillation of the golf club shaft in two dimensions transverse to the longitudinal axis of the golf club shaft.

20. The apparatus of claim 19, wherein the multi-dimensional sensor is an accelerometer.

21. The apparatus of claim 19, further including a computer having an input coupled for receiving a signal from the multi-dimensional sensor indicative of the frequency of oscillation of the golf club shaft, the computer including programming for converting the signal into an indication of the stiffness of the golf club shaft.

* * * * *